US006168485B1

(12) United States Patent
Hall et al.

(10) Patent No.: US 6,168,485 B1
(45) Date of Patent: Jan. 2, 2001

(54) PUMP JET WITH DOUBLE-WALLED STATOR HOUSING FOR EXHAUST NOISE REDUCTION

(75) Inventors: Kimball P. Hall, Wading River, NY (US); A. Michael Varney, Sewall's Point; John D. Martino, Longwood, both of FL (US)

(73) Assignee: Outboard Marine Corporation, Waukegan, IL (US)

( * ) Notice: Under 35 U.S.C. 154(b), the term of this patent shall be extended for 0 days.

(21) Appl. No.: 09/419,143

(22) Filed: Oct. 15, 1999

(51) Int. Cl.[7] ..... B63H 21/32
(52) U.S. Cl. ..... 440/89; 416/93 A
(58) Field of Search ..... 440/38, 67, 89; 416/90 A, 93 A, 189

(56) References Cited

U.S. PATENT DOCUMENTS 4,832,570 * 5/1989 Solia ..... 440/67
4,929,200 * 5/1990 Guezou et al. ..... 440/38
5,325,662 * 7/1994 Varney et al. ..... 416/93 A
5,482,482 * 1/1996 Davis ..... 440/67

* cited by examiner

*Primary Examiner*—Jesus D. Sotelo
(74) *Attorney, Agent, or Firm*—John H. Pilarski; Dennis M. Flaherty

(57) ABSTRACT

A pump jet apparatus having a double-walled stator housing containing an annular passage through which exhaust gas can flow. Gas enters the annulus through an exhaust gas inlet or port formed in the outer stator shell at the top of the stator housing, flows in two streams around the annular passage formed between the inner and outer stator shells, and exits the stator housing through exhaust outlets or ports formed in the outer stator shell near the bottom of the stator housing. The streams of exhaust gas and impelled water flowing through the stator housing of the pump jet are kept separate by the inner stator shell.

20 Claims, 8 Drawing Sheets

PUMP JET WITH DOUBLE-WALLED STATOR HOUSING FOR EXHAUST NOISE REDUCTION

FIELD OF THE INVENTION

This invention generally relates to pump jets used with outboard motors or in inboard/outboard or stern drive units of boats and other vehicles. In particular, the invention relates to pump jets in which exhaust gas from the motor is discharged into the water stream surrounding the pump jet.

BACKGROUND OF THE INVENTION

In conventional outboard motors, a propeller is driven by a powerhead to propel a boat through the water. Essentially all modern motors inject the exhaust gas stream under water in order to reduce noise of the engine. However, the injected stream of exhaust gas can occupy a space, causing drag.

Prior to the 1970s most outboard motors injected the exhaust gas from a powerhead through a downstream channel to an exhaust gas outlet 14. The exhaust is injected from the exhaust gas outlet into the water at a location downstream from the propeller. This type of motor will be referred to herein as a downstream exhaust motor.

During the 1970s, many outboard motors were changed over to a configuration in which gas from the powerhead was exhausted through a hollow hub in the propellor (provided for that purpose). The reason for the change over to an "exhaust through hub" (ETH) motor was the drag caused by the exhaust. It is known that the gear case causes drag. By locating the exhaust stream concentrically behind the gear case, the drag of the exhaust can be canceled out by the drag of the gear case. Manufacturers received an added benefit when the ETH configuration was used, namely, they were able to increase efficiency by using a larger-diameter gear case, larger crown gears, and thus slower-turning, more efficient propellers without increasing drag.

Another type of conventional outboard motor has an axial-flow pump jet system driven by the powerhead. In a pump jet system, an impeller or rotor is mounted (e.g., spline fitted) directly on the propeller output shaft in place of the propeller. There are typically no modifications to the drive train, cooling or sealing components. A ducted housing surrounds the rotor. Such a system has the advantages of reducing hazards to swimmers in the vicinity of the motor, protecting the rotating elements from interference with and damage by foreign objects in the water, and improving the efficiency and performance of the propulsion system. Another benefit inherent with the pump jet is a directed jet of water that results in greater steering response.

An example of this kind of pump jet installed on a downstream exhaust motor is shown in FIG. 1. A bladed rotary impeller or rotor is positioned below an anti-ventilation plate 12 and rearward of a lower unit housing 10. The rotor comprises a plurality of blades 18 extending radially outward from an outer rotor hub 19, the latter being is attached to a rearwardly projecting propeller shaft 16 for rotation therewith. A housing or shroud 21 having a front section or rotor housing 20 and a rear section or stator housing 22 houses the bladed rotary impeller. The rotor housing 20 is part of a one-piece rotor housing assembly, which also comprises a plurality of inlet vanes 63 and an inlet vane hub 70. Each inlet vane 63 is joined at one end to the inlet vane hub 70 and at the other end to the rotor housing 20. The inlet vanes direct water flow into the blades 18 of the rotor. The inlet vanes also block debris, sea creatures or human limbs from contacting the rotating blades of the rotor.

A bearing support 26 engages the rear end of the propeller shaft 16. The stator vanes 30, which are present to neutralize the swirl from the impeller, also serve to attach the bearing support 26 to the stator housing 22. At the rear end of the anti-ventilation plate 12 is a downwardly projecting exhaust gas outlet 14 which directs the exhaust gas into a channel 24 formed in the upper surface of the stator housing 22.

Referring to FIG. 2, a pump jet 44 is mounted on an outboard motor 32. The outboard motor 32 comprises a powerhead 34 and a leg 36. The outboard motor 32 also includes conventional anti-ventilation plate 12 and lower unit housing 10. The outboard motor 32 is preferably attached to a boat 40 or other marine vehicle or watercraft by an appropriate mounting bracket 38, which attaches to the transom of the boat hull.

During operation of the motor 32, an exhaust gas stream 110 flows downwardly from the powerhead 34 through an exhaust duct 50 positioned in the central portion of the outboard motor. The exhaust gas stream is injected in a rearward direction from the exhaust gas outlet into the water at a location downstream of the squeeze point P and above the stator housing 22.

In normal operation of a downstream exhaust motor having an attached pump jet as shown in FIG. 2, flow streamlines 102 follow the shape of the lower unit housing 10. Streamlines 104 behind the lower unit housing 10 follow the surface of the rotor housing 20 and stator housing 22. At the maximum diameter of the pump jet between the top of the pump jet surface and the bottom surface of the anti-ventilation plate 12 is a so-called "squeeze point" P. Streamlines 106 down-stream of the squeeze point P and near the surface of the pump jet try to follow the conical surface of the pump housing and streamlines 108 near the anti-ventilation plate 12 try to remain parallel thereto. During the operation of this downstream exhaust motor, drag is created downstream of the squeeze point P.

FIG. 3 diagrammatically illustrates a prior art pump jet apparatus in which an exhaust gas stream 110 flows downwardly from the powerhead 34 through an exhaust duct 62 positioned in the central portion of the outboard motor. The exhaust gas is channelled in a rearward direction from the exhaust duct 62 to an exhaust channel 42. The exhaust gas flows from the exhaust channel 42 above the stator housing 22 to exit the outboard motor 32. An exhaust extension duct 46 is positioned above the stator housing 22 and is coupled to the exhaust channel 42 for discharging the exhaust gas rearwardly of the squeeze point P. The rear end of the exhaust extension duct 46 flares outwardly for controlling the size of the exhaust gas stream. The angle of the flare of the exhaust extension duct 46 can be increased or decreased to control the expansion of the exhaust gas stream. A trough 48 is formed in the upper surface of the stator housing 22 below the exhaust extension duct 46 to receive the exhaust gas. The trough 48 allows a portion of the exhaust stream to be concealed behind the pump jet housing, whereby an improved flow of the exhaust gas stream is achieved and drag is reduced.

Since the exhaust streams of the prior art propulsion systems shown in FIGS. 1–3 are released near the water surface, the level of exhaust noise is relatively high. For pump jets to be viable on recreational watercraft, the level of exhaust noise needs to be reduced.

One current approach to this problem is to distribute the exhaust flow among several hollow stator vanes, which discharge the gas at relatively high velocity through several openings distributed circumferentially around the stator housing. The procedure is effective in reducing exhaust noise, but requires the use of rotating gas seals and hollow stator vanes. Such an "exhaust through vane" (ETV) configuration is depicted in FIG. 4. The stator housing 52 is part of a one-piece stator housing assembly, which also comprises a plurality of stator vanes 54 and a stator hub 56. Each stator vane 54 is joined at one end to the stator hub 56 and at the other end to the stator housing 52. The stator vanes 54 convert rotational energy imparted to the water flow by the rotor blades into axial flow energy at the outlet of the stator housing 52. One or more of the stator vanes 54 is hollow. Similarly, an internal cavity in the stator hub 56 forms a plenum cavity 58, which is in flow communication with each hollow stator vane. The exhaust gas from the powerhead 34 flows downwardly through an exhaust channel 60. The lower end of the exhaust channel 60 is in flow communication with a hub exhaust channel 62 which channels the exhaust stream rearward through the hub. The hub exhaust channel 62 is an annular space, which is bounded internally by the propeller shaft bearing housing 64 and the inner rotor hub 66, and externally by the wall of the gear case 68, the inlet vane hub 70 and the outer rotor hub 72. Rotating gas seals (not shown) must be installed between the outer rotor hub 72 and the stator hub 56 to prevent exhaust gas from leaking into the water jet stream inside the pump jet housing. The exhaust stream flows from the hub exhaust channel 62 to the plenum cavity 58 in stator hub 56, and then into the hollow stator vanes 54 which communicate with the plenum cavity. The exhaust stream in each hollow stator vane flows the length of the stator vane and discharges from a respective exhaust port or outlet 74 into the water stream surrounding the stator housing 52.

In ETV pump jets, the hollow stator vanes need to be large in order to provide adequate flow area for exhaust gas. But stator vanes that are too large or too numerous can begin to present significant blockage area to the water stream.

Thus, there is a need for a pump jet apparatus which requires neither hollow stator vanes nor rotating gas seals.

SUMMARY OF THE INVENTION

The present invention is a pump jet apparatus for use with marine engines mounted on boats or other watercraft, which apparatus does not include either hollow stator vanes (or hollow struts) or rotating gas seals. As used herein, the term "marine engines" includes, but is not limited to, outboard motors and inboard/outboard or stern drive units.

In accordance with the preferred embodiments, the pump jet apparatus comprises a double-walled stator housing containing an annular passage through which exhaust gas can flow. In the following written description, the two walls of the double-walled stator housing will be respectively referred to as the inner and outer stator shells. Gas enters the annulus through an exhaust gas inlet or port formed in the outer stator shell at the top of the stator housing, flows in two streams around the annular passage formed between the inner and outer stator shells, and exits the stator housing through exhaust outlets or ports formed in the outer stator shell near the bottom of the stator housing. The streams of exhaust gas and impelled water flowing through the stator housing of the pump jet are kept separate by the inner stator shell. Preferably, the exhaust outlets are circular, although the invention is not limited to the use of circular holes for exhaust outlets. For example, the exhaust outlets can be elliptical.

In accordance with a further preferred embodiment of the invention, exhaust outlet ducts are attached to the external surface of the outer stator shell. [The term "exhaust outlet duct" is adopted to distinguish the ducts attached to the stator housing from the exhaust ducts 50 and 62 depicted in FIGS. 1–4.] Each exhaust outlet duct is positioned to be in flow communication with a respective exhaust gas outlet in the outer stator shell and are configured to block "bushing out" of the exhaust gas stream flowing out of the exhaust outlets. The exhaust outlet ducts may be attached by welding or brazing, by fastening (e.g., using bolts or screws), or by any other conventional attachment means. As used herein, the term "exhaust outlet duct" is not a tubular channel, which is the normal sense in which the term is "duct" is used, but rather is a portion of a duct which acts as a shield to allow the exhaust gases to discharge from the exhaust outlets free of interaction with the water stream external to the stator housing. The outlet of each exhaust outlet duct is defined by the trailing edge of the duct portion and the opposing external surface of the outer stator shell.

Preferably, each exhaust outlet duct comprises a curved piece of sheet material, e.g., metal, having a three-dimensional curved edge which abuts the external surface of the outer stator shell along a contour which partly surrounds a corresponding exhaust outlet, and having an arc-shaped or eyebrow-shaped trailing edge which preferably lies in a plane perpendicular to the central axis of the pump jet. Preferably, the duct material is a portion of a circular cylindrical surface and lies substantially parallel to the pump jet central axis. However, the duct portions need not be sections of a circular cylinder. Other shapes may be used to decrease the cross-sectional area of the outlet formed by the outer stator shell and the trailing edge of each duct portion.

In the case where the exhaust outlet ducts are portions of a circular cylinder, exhaust gases exiting the exhaust outlets are redirected by the inner surfaces of the ducts to flow in parallel with the direction of pump jet motion. In addition, the ducts provide a cross-sectional area for the exhaust gas stream which increases from adjacent the exhaust outlet to the duct outlet formed by the outer stator shell and the trailing edge of the exhaust outlet duct. The result will be an exhaust gas stream which exits the exhaust outlet duct parallel to and at a velocity equal to or less than that of the water stream flowing along the outer surface of the exhaust outlet duct during forward motion of the pump jet (provided that the eyebrow-shaped ducts are properly sized). It is expected that the exhaust outlet ducts will achieve improved performance over the entire pump jet speed range.

DETAILED DESCRIPTION OF THE PREFERRED EMBODIMENTS

Figure 1:
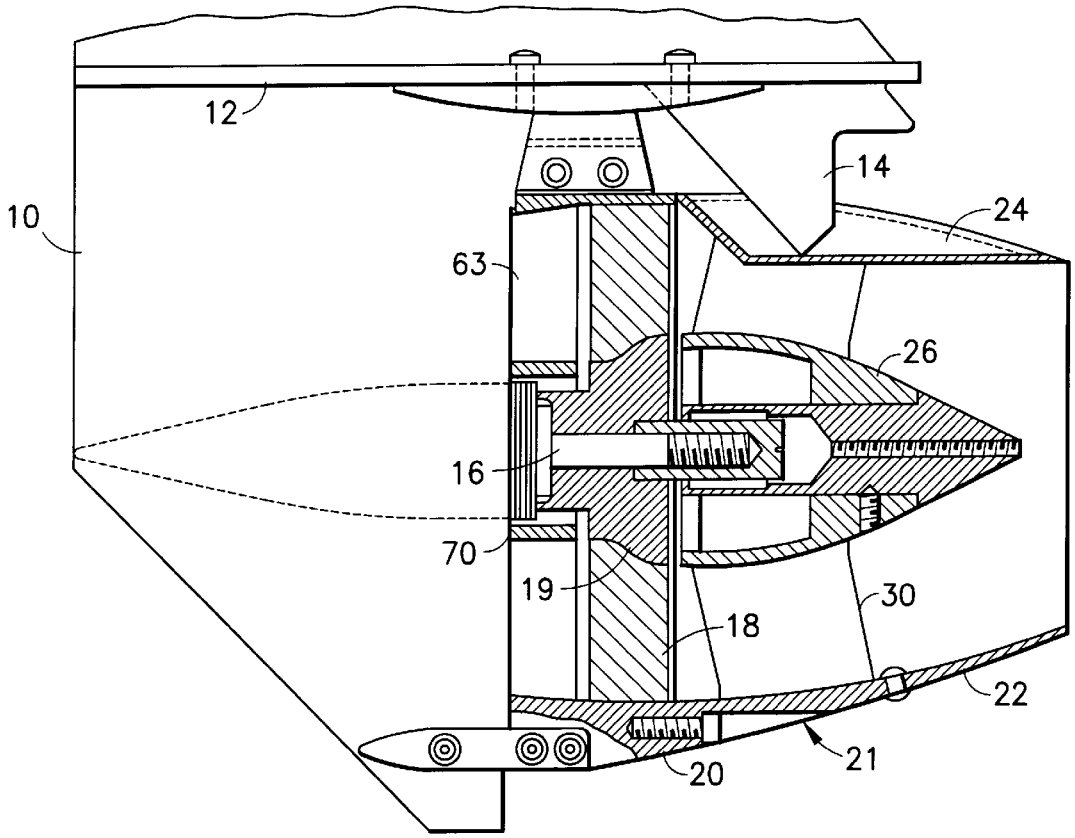
FIG. 1 PRIOR ART
FIG. 1 is a partially sectioned side elevation view of a prior art downstream exhaust pump jet.
Figure 2:
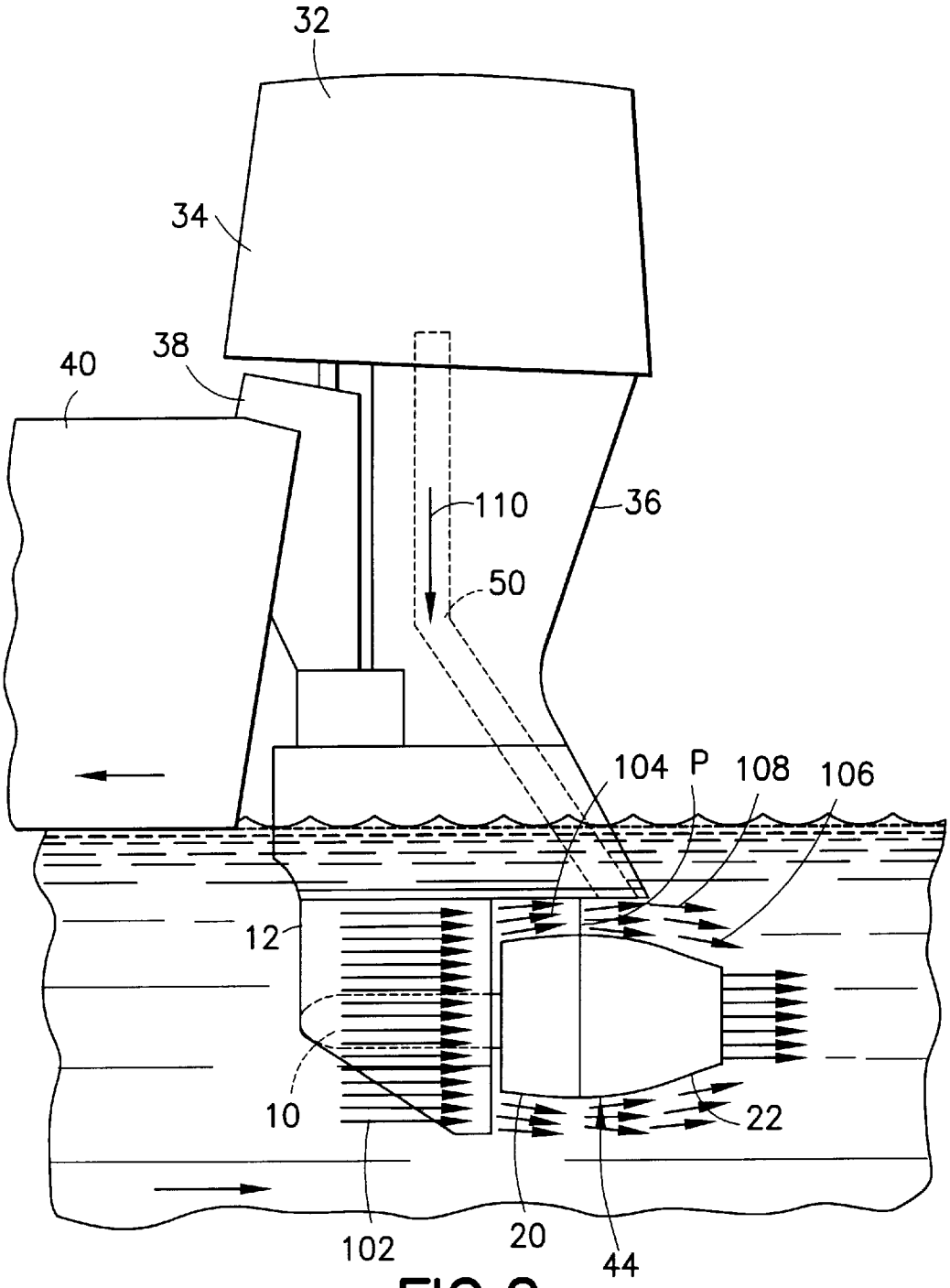
FIG.2 PRIOR ART
FIG. 2 is a schematic depicting a side elevation view of a prior art downstream exhaust motor with a pump jet.
Figure 3:
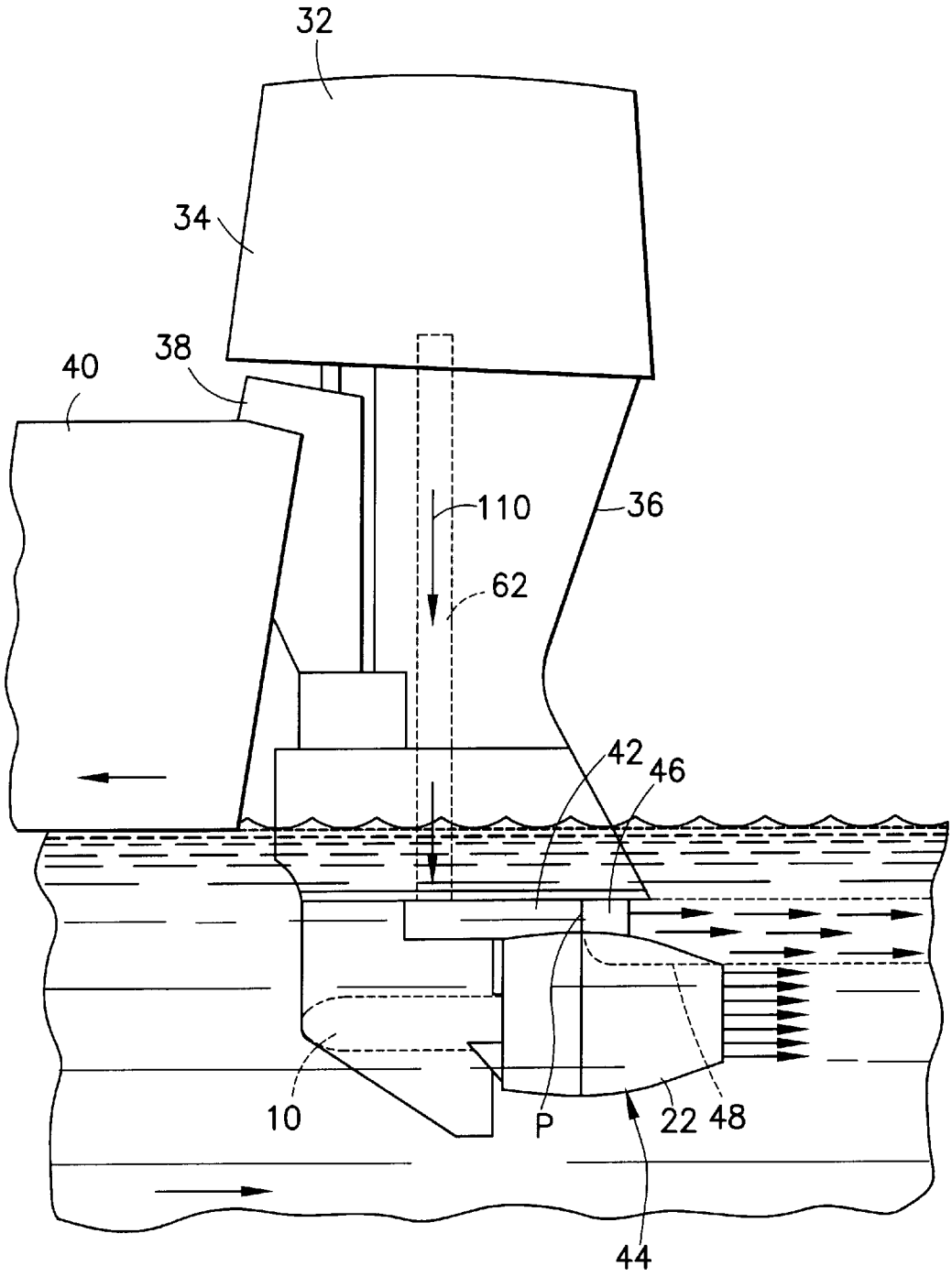
FIG.3 PRIOR ART
FIG. 3 is a schematic depicting a side elevation view of a prior art downstream exhaust motor with a pump jet and having an exhaust stream discharged rearward of the squeeze point.
Figure 4:
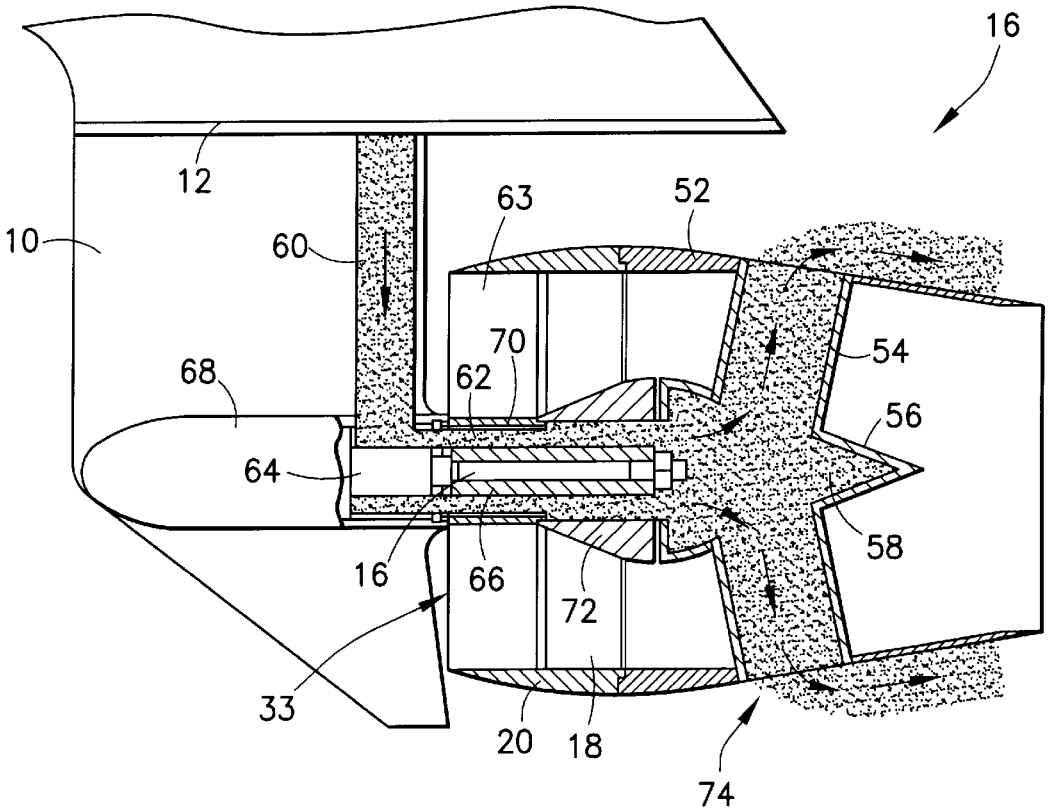
FIG.4 PRIOR ART
FIG. 4 is a partially sectioned side elevation view of a prior art ETV pump jet having exhaust streams discharged through at least two stator vanes.
Figure 5:
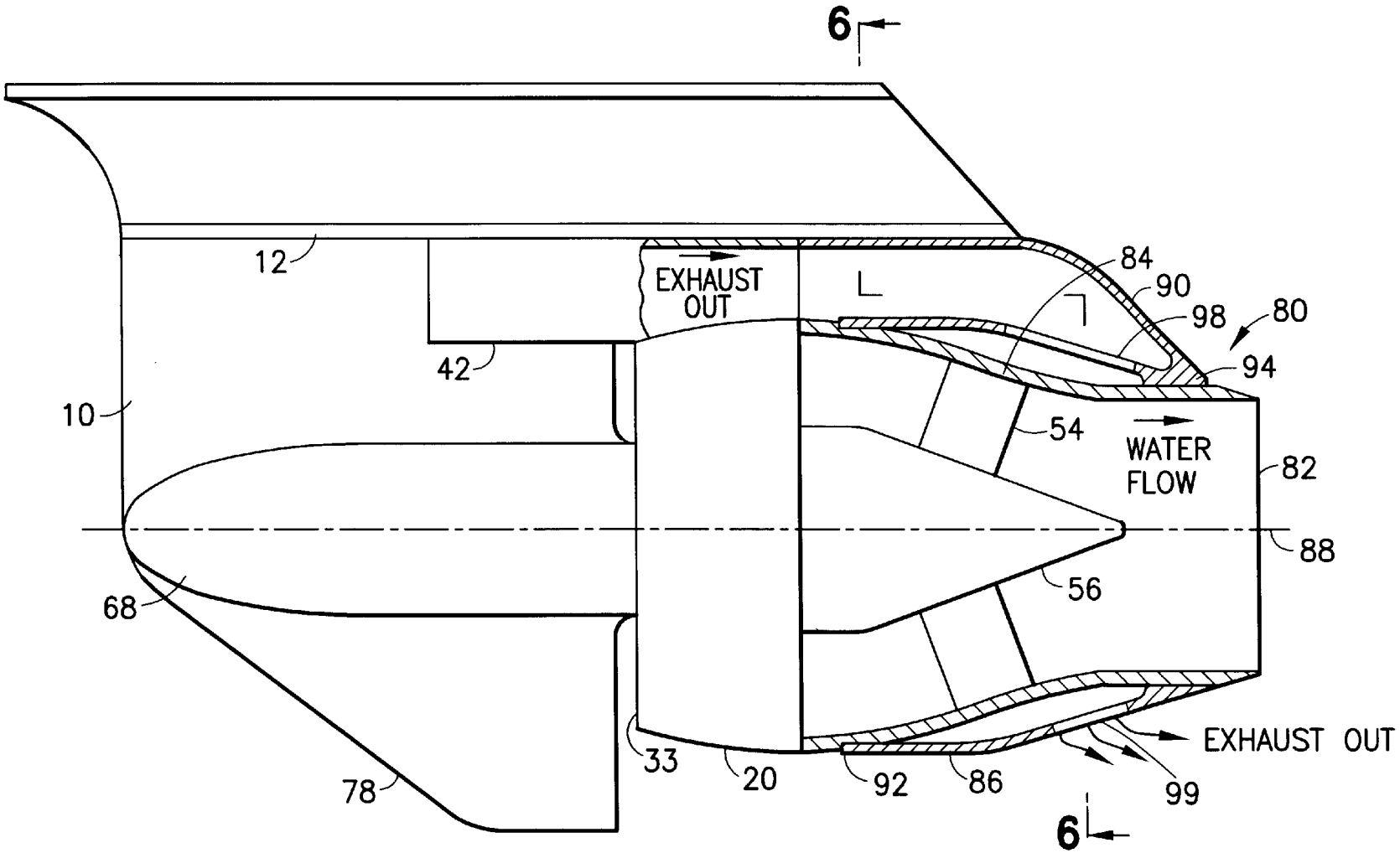
FIG. 5 is a partially sectioned side elevation view of a pump jet fitted with a double-walled stator housing in accordance with one preferred embodiment of the invention.
Figure 6:
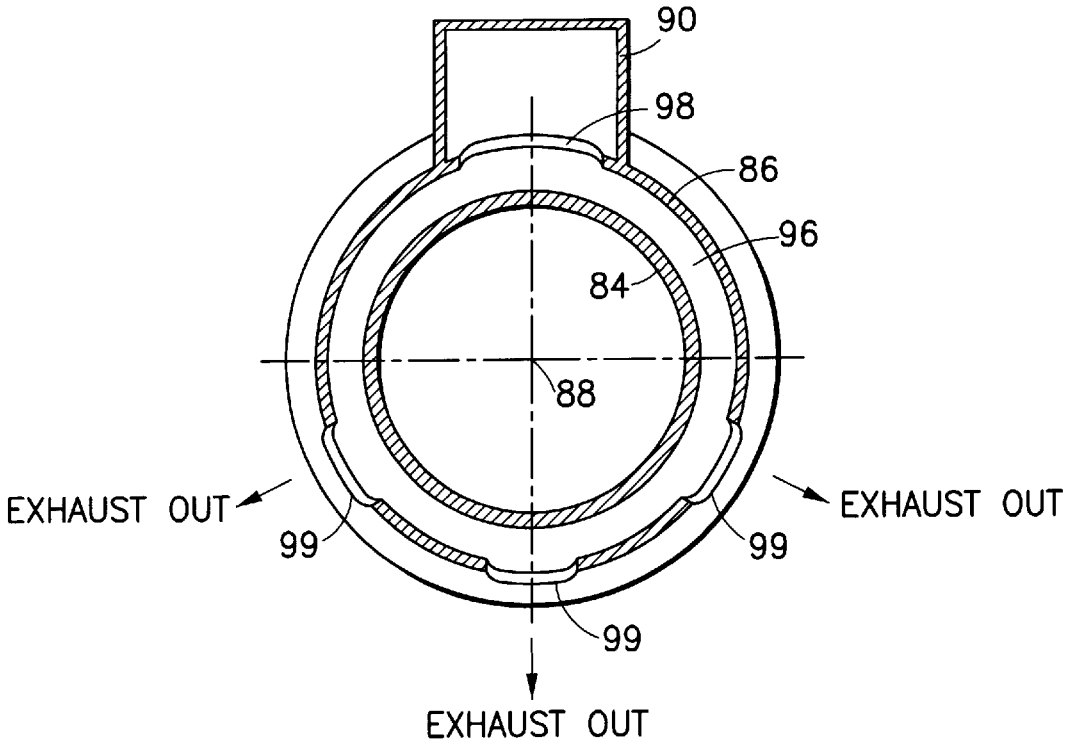
FIG. 6 is a sectional view of the pump jet shown in FIG. 5, the section being taken along section line A—A denoted in FIG. 5.

One preferred embodiment of the invention is depicted in FIGS. 5 and 6. The pump jet housing comprises a rotor housing 20 and a double-walled stator housing 80. The rotor assembly inside the rotor housing 20 may have the structure shown in FIG. 1, the structure shown in FIG. 4 or any other functionally equivalent structure. The present invention does not lie in the structure of the rotor assembly. Nor does it lie in the structure of the marine engine to which the pump jet apparatus is coupled. In particular, the invention has application with outboard motors (such as the outboard motor 32 shown in FIGS. 2 and 3) and in inboard/outboard or stern drive units (not shown) for watercraft and other vehicles. A propulsor of a stern drive unit is typically mounted to the stern or transom of a boat hull via a transom mount assembly or bracket. The shaft on which the pump jet rotor is mounted is driven to rotate by an engine mounted inside the boat via conventional gear assemblies mounted outside the boat. In addition, for outboard motor applications, lower unit housing 10, skeg 78, gear case 68, and anti-ventilation plate 12, shown in FIG. 5, may have conventional structures. Also a steering nozzle and a reverse gate may be mounted on the stator housing in conventional fashion.

Referring again to FIG. 5, the rotor housing 20, which has an inlet 33 for the intake of water, forms the upstream portion of the shroud which fully encloses the pump jet. The rearward portion of the shroud comprises the double-walled stator housing 80 which has an outlet 82 for the water propelled rearward by the rotor blades. The double-walled stator housing 80 preferably comprises two parts: an inner stator shell 84 and an outer stator shell 86. However, a person skilled in the art will recognize that the double-walled stator may alternatively comprise a monolithic piece or more than two pieces. The inner stator shell 84 is a slight modification of stator housings of current design, the latter preferably being shaped as a surface of revolution having an axis of symmetry coaxial with the pump jet centerline 88. The inner stator shell 84 has an upstream edge which form fits with the downstream edge of the rotor housing 20. The outer stator shell 86 is preferably configured to slide onto inner stator shell 84 like a boot slides onto a leg, and can be fastened in place with screws, longer but similar to, those currently used to attach the conventional one-piece stator housing to the rotor housing.

Installation of a pump jet in accordance with the preferred embodiments comprises the following steps: (1) attach the rotor housing 20 to the anti-ventilation plate 12 and skeg 78; (2) install the rotor on the propellor shaft (not shown in FIGS. 5 and 6); and (3) attach the rotor housing 20, the inner stator shell 84 and the outer stator shell together by means of screws (not shown). The inner stator shell 84 has a generally conical portion which decreases in internal diameter in the downstream direction. The minimum internal diameter of inner stator shell 84 is preferably located at the outlet 82.

In accordance with the embodiment depicted in FIGS. 5 and 6, the inner stator shell 84 is part of an assembly which also comprises a plurality of stator vanes 54 and a stator hub 56. Each stator vane 54 is joined at one end to the stator hub 56 and at the other end to the inner stator shell 84. The stator vanes convert rotational energy imparted to the water flow by the rotor blades into axial flow energy at the stator housing outlet 82.

The outer stator shell 86, on the other hand, is preferably integrally formed with an exhaust extension duct 90. Preferably, the outer stator shell 86 is shaped as a surface of revolution having an axis of symmetry coaxial with the pump jet centerline 88, i.e., coaxial with the axis of symmetry of the inner stator shell 84. The circular upstream edge 92 of the outer stator shell 86 is dimensioned to seat on a shoulder machined into the external surface of an upstream portion of the inner stator shell 84. The circular downstream edge 94 of the outer stator shell 86 is dimensioned to seat on the external surface of a downstream portion of the inner stator shell 84. Between edges 92 and 94 of the outer stator shell 86, the internal diameter of the outer stator shell 86 is greater than the outer diameter of the inner stator shell 84 by a gap dimension which increases to a maximum at a point between edges 92 and 94, thereby forming a generally annular passage 96 having inner and outer diameters (and height) which vary in a longitudinal direction (i.e., parallel to the pump jet centerline axis 88). The annular passage 96 surrounds a mid-portion of the closed inner stator shell 84. The top of the annular passage 96 is in flow communication with the exhaust extension duct 90 via an opening 98 formed in the outer stator shell 86. Opening 98 is preferably circular. The lower half of the annular passage 96 is in flow communication with the space external to the outer stator shell 86 via one or more exhaust outlets 99, also formed in the outer stator shell 86. Although only one exhaust outlet 99 is visible in FIG. 5, three can be seen in FIG. 6. Each of the exhaust outlets 99 is preferably a circular opening. In addition, the exhaust outlets 99 are preferably distributed at equal angular intervals along a portion of the circumference of the outer stator shell 86, as best seen in FIG. 6.

The exhaust extension duct 90 preferably has a rectangular cross section at its upstream end (to match rectangular outlet 42), as best seen in FIG. 6, but gradually changing to a semi-circular cross section downstream of the anti-ventilation plate. The exhaust extension duct 90 is open at its upstream edge, the latter being attached to and in flow communication with the downstream edge of the exhaust channel 42. Both the exhaust extension duct 90 and the exhaust channel 42 can be attached to the underside of the anti-ventilation plate 12. The exhaust gas stream from the marine engine flows from the exhaust channel 42 into the exhaust extension duct 90 and then into the annular passage 96 via the opening 98. The exhaust gas stream then divides—one half flowing clockwise in the right-hand half of the annular passage 96, as seen in FIG. 6, and the other half flowing counterclockwise in the left-hand half of the annular passage 96. Finally, in the preferred embodiment of FIG. 5, the exhaust gas exits the stator housing through three round exhaust outlets 99. [The person skilled in the art will appreciate, however, that fewer or more than three exhaust outlets can be used. The present invention is not limited to a particular number of exhaust outlets.] The cross-sectional area of the exhaust extension duct 90, the diameter of opening 98, the total cross-sectional area of the two branches of the annular passage 96, and the diameter of the exhaust outlets 99 can be designed such that the most constricted point of the entire flow path is the cross section of the split path around the annular passage 96.

The double-walled stator housing shown in FIGS. 5 and 6 can be designed to eject exhaust gas at a velocity in the neighborhood of the velocity of the water flowing past the pump when the boat is moving at top speed. Further, the gas is being ejected into the water at a lower depth than is the case for a comparable propeller-driven design. Thus, the invention reduces the noise produced by the marine engine exhaust gas stream. However, the propeller-driven design has one advantage: not only is there a good match between the water stream velocity and the velocity of the ejected gas stream; there is a perfect match between the vector directions of the two flowing streams. In contrast, the embodiment shown in FIGS. 5 and 6 ejects exhaust gas into the water stream surrounding the stator housing 80 at a vector direction almost at right angles to the direction of water flow. Without further structural modification of the pump jet shown in FIGS. 5 and 6, the exhaust gas stream will "bush out" and present a significant added frontal area to the water stream, producing added drag.

Figure 8:
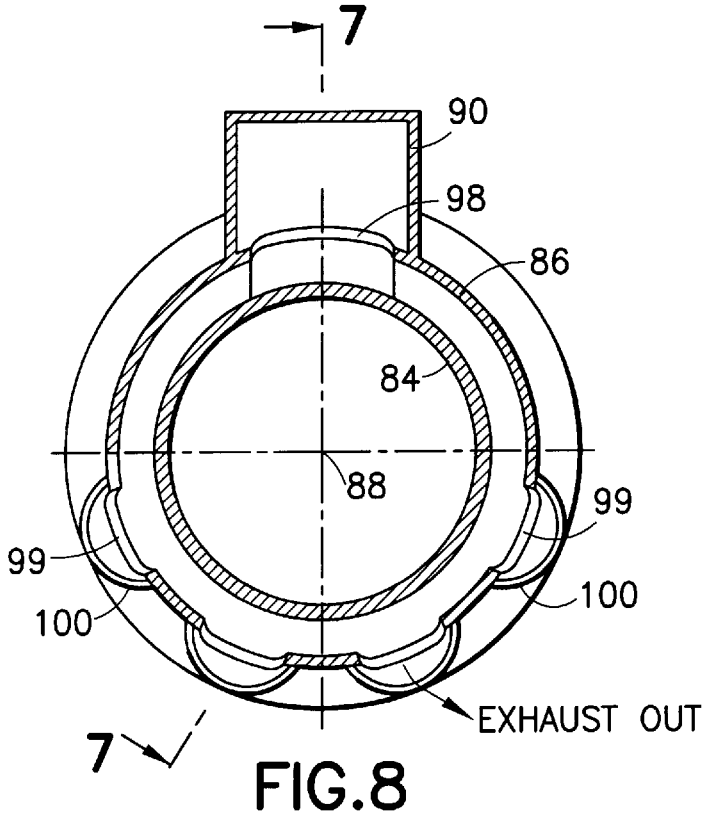
FIG. 8 is a sectional view of the pump jet shown in FIG. 7, the section being taken along section line A—A denoted in FIG. 7. Section line B—B in FIG. 8 denotes the section taken in FIG. 7.
Figure 7:
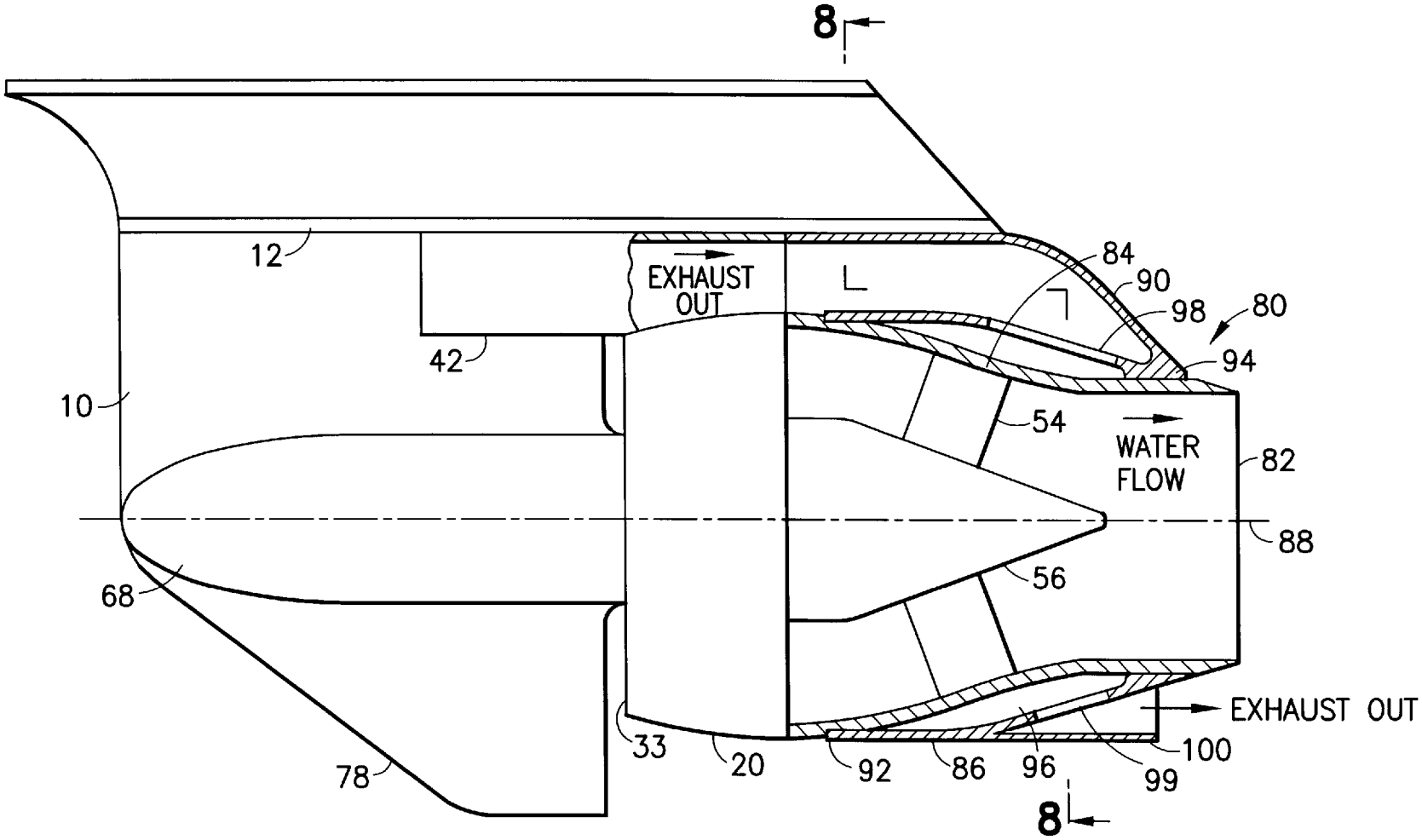
FIG. 7 is a partially sectioned side elevational view of a pump jet fitted with a double-walled stator housing having exhaust outlet ducts in accordance with another preferred embodiment of the invention.

There is a way to deflect the flowing stream of exhaust gas so it flows parallel with the stream of water, however. A preferred embodiment for accomplishing the foregoing is illustrated in FIGS. 7 and 8. In this example, four round exhaust outlets 99 are provided in the lower half of the annular passage 96. The four exhaust outlets 99 are preferably distributed at equal angular intervals along a portion of the circumference of the outer stator shell 86, as best seen in FIG. 8.

In accordance with the preferred embodiment shown in FIGS. 7 and 8, exhaust outlet ducts 100 are attached to the external surface of the stator housing 60. Each exhaust outlet duct 100 is positioned to overlie a respective exhaust gas outlet 99. The exhaust outlet ducts 100 may be attached by welding or brazing, by fastening (e.g., using bolts or screws), or by any other conventional attachment means. Preferably, each exhaust outlet duct 100 comprises a curved piece of sheet material, preferably metal, having a three-dimensional curved edge which abuts the external surface of the outer stator shell 86 and is joined thereto (e.g., by tack welding) along a contour which partly surrounds the corresponding exhaust outlet 99; and having an arc-shaped or eyebrow-shaped trailing edge (best seen in FIG. 8) which preferably lies in a plane perpendicular to the axis of the pump jet. Preferably, the duct material is a concave segment of a cylindrical (e.g., circular cylindrical) surface and lies substantially parallel to the pump jet central axis 88. For example, each exhaust outlet duct 100 can be a piece cut from aluminum tubing having a circular cross section. In this case, exhaust gases exiting the exhaust outlets will be redirected by the inner surfaces of the ducts to flow in parallel with the pump jet axis, i.e., in parallel with the direction of pump jet motion. Thus, the exhaust outlet ducts function as walls to block "bushing out" of the exhaust gas stream being discharged from the exhaust outlets. In addition, the ducts provide a cross-sectional area for the exhaust gas stream which increases from a point adjacent the exhaust outlet to the duct outlet formed by the external surface of the outer stator shell 86 and the trailing edge of the exhaust outlet duct. The cross-sectional area of the exhaust extension duct 90, the diameter of opening 98, the total cross-sectional area of the two branches of the annular passage 96, the diameter of the exhaust outlets 99 and the radius of curvature of the exhaust outlet ducts 100 can be designed such that gas emerging from the four exhaust outlet ducts 100 would show a reasonably close velocity match to that of the water stream both in magnitude and in vector direction. The result will be an exhaust gas stream which exits the exhaust outlet duct parallel to and at a velocity equal to or less than that of the water stream flowing along the outer surface of the exhaust outlet duct during forward motion of the pump jet.

Selection of the appropriate dimensions to achieve an approximate match of gas velocity and water velocity (a velocity match) requires the designer to make reasonable estimates of the volume rate of exhaust gas being discharged by the engine and the speed at which the motor will be traveling. The gas exit velocity equals the volume rate of discharge in cubic feet divided by the total eyebrow exit area in square feet.

If a stator housing having eyebrow-shaped exhaust outlet ducts as shown in FIGS. 7 and 8 were to be tested in a water tunnel without gas flow, one would expect that the "chopped-off" trailing edge of each eyebrow-shaped duct would produce additional drag (hereinafter "base drag"). However, when gas flow through the hollow stator vanes is established—with the gas flow velocity equal to or slightly less than the water stream velocity—the base drag vanishes. Thus, the placement of eyebrow-shaped exhaust outlet ducts 100 over the exhaust outlets 99 eliminates both the directional mismatch and (with properly sized eyebrow-shaped ducts) the velocity mismatch.

A pump jet like that shown in FIG. 5 and 6, operating near full speed, introduces exhaust gas into the flowing water stream with a minimum of commotion. The exhaust stream exits the pump at an angle, but should quickly turn and merge with the water, slowly rising to the surface. The resulting noise level should be much lower than that from prior art pump jets, where the exhaust gas emerges forcefully, at a higher velocity than the water, and near the surface.

A pump jet like that shown in FIGS. 7 and 8 should be even quieter, because the exhaust streams from the eyebrow exhaust outlet ducts gently merge with the water stream external to the stator housing.

Figure 9:
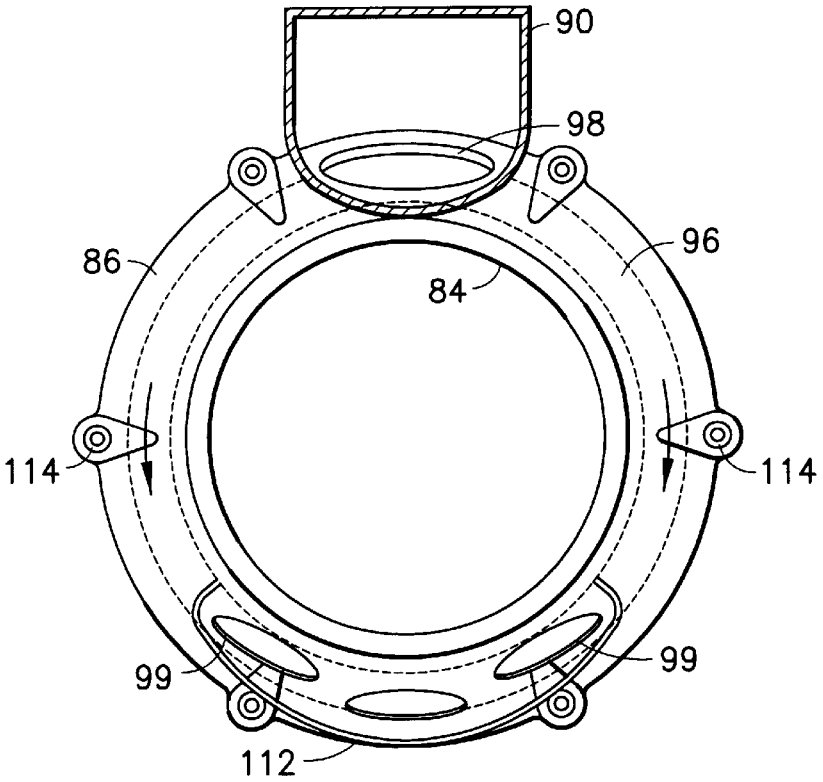
FIG. 9 is a rear view of a double-walled stator housing having a partial exhaust outlet skirt in accordance with yet another preferred embodiment of the invention. The exhaust extension duct is shown in section to reveal the opening at the top of the annular passage.
Figure 10:
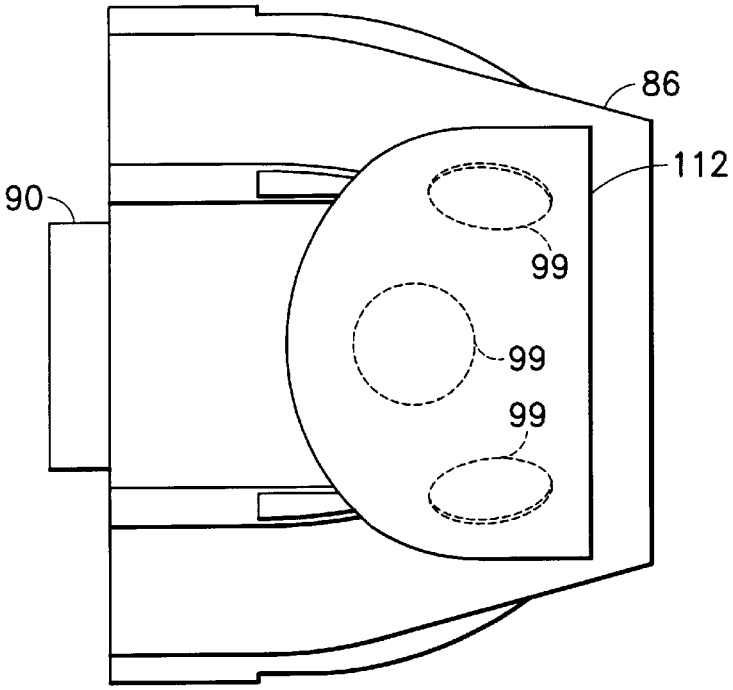
FIG. 10 is a bottom view of the outer stator shell of the double-walled stator housing with partial skirt shown in FIG. 9.

Instead of providing a respective exhaust outlet duct for each exhaust outlet, a single wall or partial skirt 112 can be placed over the exhaust outlets, as depicted in FIGS. 9 and 10. As also shown in FIG. 9, the inner and outer stator shells 84 and 86 are attached to the rotor housing by means of a plurality of circumferentially distributed screws 114. In addition, FIG. 10 shows that the centers of exhaust outlets 99 need not all be aligned in a radial plane.

While the invention has been described with reference to a preferred embodiment, it will be understood by those skilled in the art that various changes may be made and equivalents may be substituted for elements thereof without departing from the scope of the invention. For example, one could readily conceive of a double-walled stator housing in which the inlet and outlet of the outer stator shell communicate via only a semicircular passage, corresponding in structure to one of the two branches of the annular passage disclosed hereinabove. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

As used in the claims, the term "marine engines" includes both inboard and outboard motors.

What is claimed is:

1. A housing for a pump jet apparatus, comprising:

an outer stator shell having first and second openings respectively located in opposite halves of said outer stator shell; and an inner stator shell disposed inside said outer stator shell in generally coaxial relationship therewith, wherein said inner and outer stator shells define a generally annular passage therebetween, said annular passage being in flow communication with said first and second openings.

2. The housing as recited in claim 1, wherein said inner stator shell has an inlet and an outlet, further comprising a rotor housing having an inlet and an outlet, said inlet of said inner stator shell being coupled to and in flow communication with said outlet of said rotor housing.

3. The housing as recited in claim 1, further comprising a wall overlying said second opening in said outer stator shell, said wall comprising a first edge portion attached to said outer stator shell and a second edge portion not attached to said outer stator shell, wherein said second edge portion of said wall and said outer stator shell define an opening which is in flow communication with said second opening in said outer stator shell.

4. The housing as recited in claim 3, wherein said wall is a cylindrical section of sheet material disposed substantially parallel to a common axis of said inner and outer stator shells.

5. A pump jet apparatus for a marine engine, comprising:

a rotor assembly mounted on a rotatable shaft having an axis of rotation;

a first housing surrounding said rotor assembly and having an inlet and an outlet, an axis of said first housing being generally coaxial with said axis of rotation;

a second housing having an inlet and an outlet, said inlet of said second housing being coupled to and in flow communication with said outlet of said first housing;

a duct having an open end for receiving exhaust gas from the marine engine; and a shell having first and second openings respectively located in opposite halves of said shell, said shell being disposed outside said second housing in generally coaxial relationship therewith, wherein said shell and said second housing define a generally annular passage therebetween, said duct being in flow communication with said generally annular passage via said first opening in said shell, and said generally annular passage being in flow communication with a space external to the pump jet apparatus via said second opening in said shell.

6. The pump jet apparatus as recited in claim 5, further comprising a wall overlying said second opening in said shell, said wall comprising a first edge portion attached to said shell and a second edge portion not attached to said shell, wherein said second edge portion of said wall and said shell define an opening which is in flow communication with said second opening in said shell.

7. The pump jet apparatus as recited in claim 6, wherein said wall is a cylindrical section of sheet material disposed substantially parallel to a common axis of said second housing and said shell.

8. The pump jet apparatus as recited in claim 5, further comprising means for blocking radially outward flow of exhaust gas exiting said second opening in said shell.

9. The pump jet apparatus as recited in claim 5, further comprising a stator hub and a plurality of stator vanes, one end of each of said stator vanes being connected to said stator hub and the other end of each of said stator vanes being connected to said second housing.

10. A pump jet apparatus for a marine engine, comprising:

a rotor assembly mounted on a rotatable shaft having an axis of rotation;

a first housing surrounding said rotor assembly and having an inlet and an outlet, an axis of said first housing being generally coaxial with said axis of rotation;

a second housing having an inlet and an outlet, said inlet of said second housing being coupled to and in flow communication with said outlet of said first housing;

a duct having an open end for receiving exhaust gas from the marine engine; and means for delimiting a generally annular passage surrounding a portion of said second housing, said annular passage delimiting means having first and second openings respectively located in opposite halves thereof, where in said duct is in flow communication with said generally annular passage via said first opening, and said generally annular passage is in flow communication with a space external to the pump jet apparatus via said second opening.

11. The pump jet apparatus as recited in claim 10, further comprising a wall overlying said second opening, said wall comprising a first edge portion attached to said annular passage delimiting means and a second edge portion not attached to said annular passage delimiting means, wherein said second edge portion of said wall and said annular passage delimiting means define an opening which is in flow communication with said second opening.

12. The pump jet apparatus as recited in claim 11, wherein said wall is a cylindrical section of sheet material disposed substantially parallel to a common axis of said second housing and said annular passage delimiting means.

13. The pump jet apparatus as recited in claim 10, further comprising means for blocking radially outward flow of exhaust gas exiting said second opening.

14. The pump jet apparatus as recited in claim 10, wherein said annular passage delimiting means comprise a shell attached to said second housing in generally coaxial relationship therewith.

15. The pump jet apparatus as recited in claim 10, further comprising a stator hub and a plurality of stator vanes, one end of each of said stator vanes being connected to said stator hub and the other end of each of said stator vanes being connected to said second housing.

16. An apparatus for propelling a watercraft, comprising:

a powerhead which produces exhaust gas;

an exhaust channel in flow communication with said powerhead for receiving exhaust gas therefrom;

a rotatable shaft driven to rotate by operation of said powerhead, said rotatable shaft having an axis of rotation;

a rotor assembly mounted on said rotatable shaft;

a first housing surrounding said rotor assembly and having an inlet and an outlet, an axis of said first housing being generally coaxial with said axis of rotation;

a second housing having an inlet and an outlet, said inlet of said second housing being coupled to and in flow communication with said outlet of said first housing;

a shell having first and second openings respectively located in opposite halves of said shell, said shell being disposed outside said second housing in generally coaxial relationship therewith, wherein said shell and said second housing define a generally annular passage therebetween, said exhaust channel being in flow communication with said generally annular passage via said first opening in said shell, and said generally annular passage being in flow communication with a space external to the apparatus via said second opening in said shell.

17. A pump jet apparatus for a marine engine, comprising:

a rotor assembly mounted on a rotatable shaft having an axis of rotation;

a rotor housing surrounding said rotor assembly and having an inlet and an outlet, an axis of said rotor housing being generally coaxial with said axis of rotation;

a stator housing having an inlet and an outlet, said inlet of said stator housing being coupled to and in flow communication with said outlet of said rotor housing, wherein said stator housing comprises:

an outer stator shell having first and second openings respectively located in opposite halves of said outer stator shell; and an inner stator shell disposed inside said outer stator shell in generally coaxial relationship therewith, wherein said inner and outer stator shells define a generally annular passage therebetween, said annular passage being in flow communication with said first and second openings.

18. The pump jet apparatus as recited in claim 17, further comprising means for blocking radially outward flow of exhaust gas exiting said second opening.

19. The pump jet apparatus as recited in claim 17, further comprising a stator hub and a plurality of stator vanes, one end of each of said stator vanes being connected to said stator hub and the other end of each of said stator vanes being connected to said second housing.

20. An apparatus for propelling a watercraft, comprising:

a powerhead which produces exhaust gas;

an exhaust channel in flow communication with said powerhead for receiving exhaust gas therefrom;

a rotatable shaft driven to rotate by operation of said powerhead, said rotatable shaft having an axis of rotation;

a rotor assembly mounted on said rotatable shaft;

a rotor housing surrounding said rotor assembly and having an inlet and an outlet, an axis of said rotor housing being generally coaxial with said axis of rotation;

a stator housing having an inlet and an outlet, said inlet of said stator housing being coupled to and in flow communication with said outlet of said rotor housing, wherein said stator housing comprises:

an outer stator shell having first and second openings respectively located in opposite halves of said outer stator shell; and an inner stator shell disposed inside said outer stator shell in generally coaxial relationship there-with, wherein said inner and outer stator shells define a generally annular passage therebetween, said annular passage being in flow communication with said exhaust channel via said first opening in said outer stator shell and with a space external to the apparatus via said second opening in said outer stator shell.

* * * * *